United States Patent [19]

Vesbach

[11] 4,102,382

[45] Jul. 25, 1978

[54] OVERHEAD DOOR OPERATOR

[76] Inventor: Edwin G. Vesbach, 12011 W. Scherrei Dr., Franklin, Wis. 53132

[21] Appl. No.: 794,192

[22] Filed: May 5, 1977

[51] Int. Cl.[2] ..... E05F 15/00; E05F 15/08

[52] U.S. Cl. ..... 160/188; 160/193

[58] Field of Search ..... 160/188, 193; 254/189; 298/35 M

[56] References Cited

U.S. PATENT DOCUMENTS

| | | | |
|---|---|---|---|
| 2,221,216 | 11/1940 | Greegor et al. | 160/188 |
| 2,625,390 | 1/1953 | McFadden | 160/188 |
| 2,634,124 | 4/1953 | Davis | 160/188 |
| 2,703,235 | 3/1955 | Reamey | 160/193 |
| 2,736,553 | 2/1956 | Brown | 160/188 |
| 2,772,010 | 11/1956 | Buehring | 254/189 |
| 2,943,886 | 7/1960 | Wilkinson | 298/35 M |
| 3,185,528 | 5/1965 | Peterson | 298/35 M |
| 3,537,503 | 11/1970 | Simmonds | 160/193 |

*Primary Examiner*—Peter M. Caun

*Attorney, Agent, or Firm*—Wheeler, Morsell, House & Fuller

[57] ABSTRACT

An operator for an overhead door comprises a fluid actuated device including a cylinder and a cooperating piston. The piston rod carries a pair of cable sheaves. Another pair of sheaves are rotatable on a fixed mounting. A cable is wound around pulleys in corresponding pairs. Each cable has one end anchored and another end fastened to the door so when the fluid actuated devices spread the pair of sheaves, the door lifts. Pressurized fluid is relieved from the cylinder to let the door close under its own weight. Electric circuits for actuating the hydraulic circuit are shown.

8 Claims, 6 Drawing Figures

OVERHEAD DOOR OPERATOR

BACKGROUND OF THE INVENTION

This invention relates to a fluid actuated operator for raising and lowering an overhead door. A typical use of the new door operator and the control system therefoı is in connection with overhead garage doors of the multiple panel or single panel types.

Most overhead doors are counterpoised with a spring or a counterweight system so that energy will be stored during door closing and energy may be extracted during door opening. If the door is counterpoised as well as possible, the amount of manual energy required for opening the door need be only sufficient to make up the frictional and other losses in the system. During opening most of the energy for lifting the door is derived from that which is stored in the spring or counterweight system. Also, during door closing, only an amount of energy is required for making up the frictional losses since most of the energy that is transferred to the spring or counterweight storage system is derived from the weight of the descending door.

Use of electromechanical operators for automatic opening and closing of overhead doors is becoming quite common, especially in connection with folding overhead doors that are used on garages associated with homes. When these electromechanical door operators are used on newly constructed doors or retrofitted to existing doors, the spring or counterweight counterpoising system enables a smaller drive motor to be used since, as with a manually operated door, energy only needs to be put into the system for overcoming losses in the mechanism since the door opens largely under the influence of the counterpoising system and closes largely under the influence of its own weight.

Doors which have stored energy devices such as those described above can create a number of problems for the user. For instance, if the user or other inexperienced person or, even an experienced person, attempts to adjust the amount of counterweight or the torque of the spring to obtain good balance or counterpoising, releasing the spring or counterweight for adjustment may result in a sudden release of all of the stored energy. Breakage of a link or cable, or the like, could have similar results. This could propel a tool which a person is using to make the adjustment through the air and possibly cause injury or some part of the counterpoising mechanism may be set in high speed motion which might cause injury if the person is in contact with the part. For these and other reasons, eliminating the energy storage devices would be desirable.

The present invention uses a fluid actuated operator for overhead doors of a type which spreads cable sheaves apart to take up cable and lift the door. This enables eliminating springs and counterweights and any other energy storing systems. In a preferred embodiment, a hydraulic actuator is used. Insofar as can be ascertained, no one has heretofore used a hydraulic actuator and cable sheave spreader to open and close overhead doors although hydraulic actuators have been used for other raising and lowering operations for along time. For instance, U.S. Pat. No. 181,761 shows a hydraulic actuator and a cable system for raising and lowering a load-bearing elevator. U.S. Pat. No. 1,188,760 uses a hydraulic actuator to spread apart sheaves over which a cable is run to a load so that when the sheaves are separated from each other by the actuator the load will be lifted. In U.S. Pat. No. 2,943,886 a cable is tensioned with a hydraulic actuator to open the gates on a dump truck. In U.S. Pat. No. 3,823,918 a hydraulic actuator is used to separate sheaves over which a cable is run for moving a scenery bar on a stage. None of these prior patents suggests using a hydraulic actuator on an overhead door, nor does it suggest the type of controls which will be hereinafter described in connection with the new hydraulic actuator, door and control system, combination.

SUMMARY OF THE INVENTION

A primary object of this invention is to provide an overhead door operator which permits opening a door under the influence of fluid pressure and closing a door by controlling the fluid discharge to thereby avoid the disadvantageous feature of storing energy in a spring or weight counterbalancing system as is required in conventional electromechanical door operators.

Other objects of the invention are to provide a fluid responsive overhead door operator which: is easy to adjust and maintain; uses few parts; is compact and easy to install in low head room buildings; operates smoothly and quietly; and has several features which make its installation and use safer.

Another object is to provide an overhead door operator which can be installed, adjusted or removed by a comparatively unskilled person without the need for excessive concern about safety as is the case with prior door operators where high energy is stored in spring mechanisms and subject to sudden and unexpected release.

Briefly stated, a preferred embodiment of the new overhead door operator comprises a fluid actuated work cylinder such as a hydraulic cylinder which is preferably fixed on the building above the overhead door. A piston in the cylinder has the usual piston rod which carries a bracket to which one of a pair of similar cable sheaves are mounted for rotation and for translation on the rod. Another pair of sheaves are mounted for rotation on a stationary mounting. Cables are reeved several times around the stationary and translatable sheaves. One end of each cable is anchored and the other end of each cable attaches to one side of the overhead door near its bottom. Pressurizing the cylinder with fluid on one side of the piston causes the translatable sheaves to be spread away from the stationary sheaves in which case tension is developed in the cables leading to the door and the door rises. The door may be closed under the influence of its own weight by bleeding fluid from the pressurized cylinder, in which case the cable tension developed by the weight of the door causes the translatable and stationary sheaves to contract toward each other until the door reaches the lower limit of its travel and stops.

The control system enables the user to command opening and closing the door by simply pressing push buttons momentarily and then letting the door run until limit switches for both directions automatically stop its motion. The consequences of the door colliding with anything while it is closing are avoided by use of a pneumatic operator which responds to a collision by causing the control system to arrest movement of the door and reverse its direction of movement quickly. Means for remotely controlling the operator with a radio receiver and a treadle switch are also provided.

How the aforementioned and other objects of the invention are achieved will be evident in the ensuing description of an illustrative embodiment of the invention in connection with which reference will be made to the drawings.

DESCRIPTION OF A PREFERRED EMBODIMENT

Figure 1:
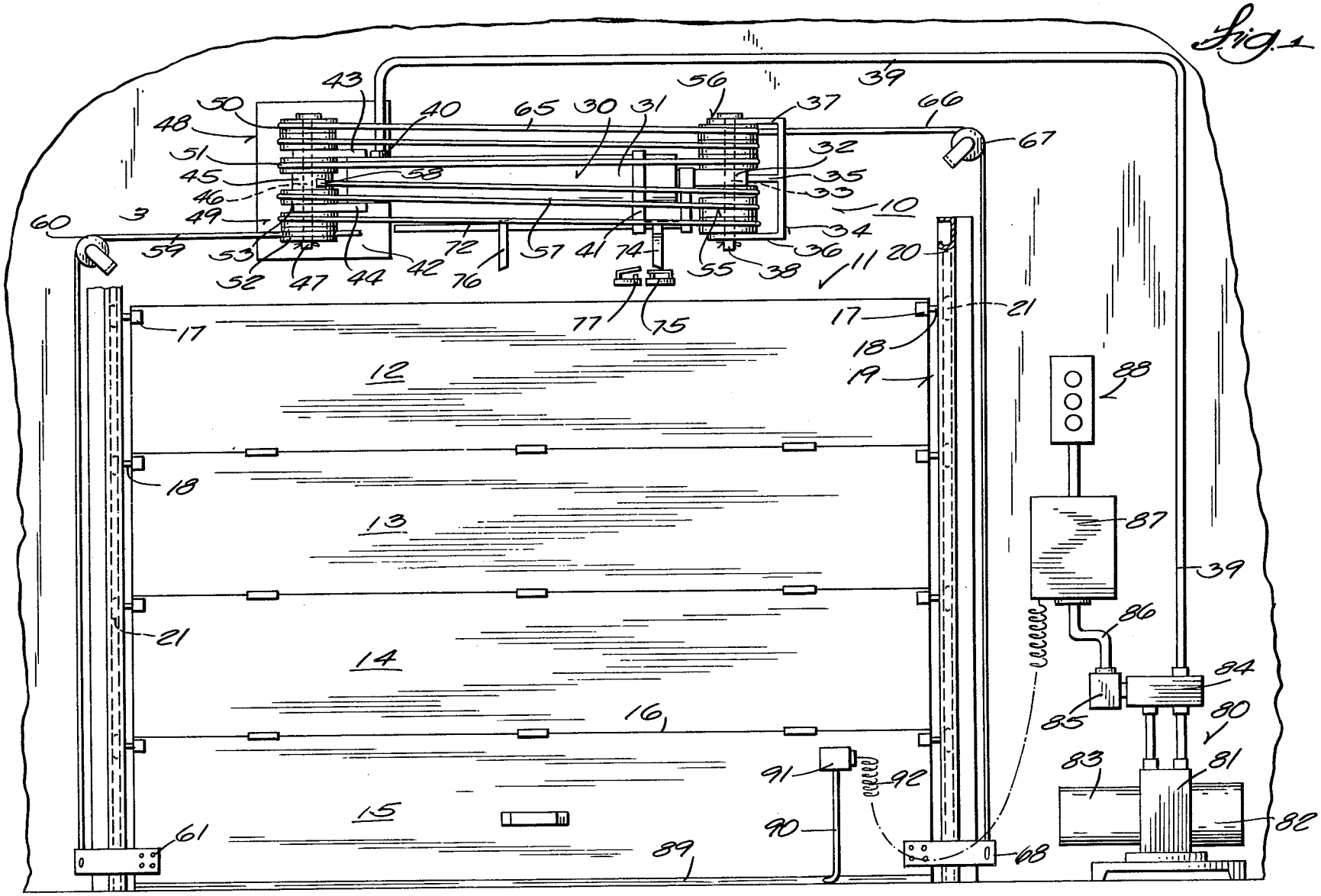
FIG. 1 is an elevation view of a sectional overhead door in association with the new fluid actuated operator.

In FIG. 1, the new door operator is generally designated by the reference numeral 10. It is arranged for cooperating with an overhead door 11 of the type which is commonly used as a garage door. This conventional door comprises four panels 12, 13, 14 and 15 which are hinged to each other with several hinges, one of which is marked 16. At opposite ends or side edges of each panel there is a bracket such as the one marked 17 which is fastened to panel 12. These brackets, respectively, secure a shaft 18 on which there is a roller, usually a ball bearing which is not visible in the drawing but is well known. Typically, on the right side of the door in FIG. 1 a stationary track 19 is fastened to the wall of the bulding adjacent the door. The track has the vertical portion which is shown and, usually at about the level of the top panel of the door, the track is curved away from the door to form a horizontal part of the track. In FIG. 1, a section is taken through the track in the region of the curve. The cross section of the bottom lip 20 of the track is seen to be concave to assure that the rollers 21 with their convex peripheries will always run along a straight line.

The multiple panel door shown in FIG. 1 is illustrative of one kind of door that can be opened and closed with the new operator 10. It should be understood, however, that the new fluid actuated operator may be used with other types of doors too.

The new fluid actuated door operator 10 will now be described in greater detail. As shown in FIG. 1, the operator may be mounted on the wall of the building above door 11. The panels of the door will not strike the operator when the door moves up to open since the panels become inclined toward the observer in FIG. 1 when the panels get onto the curved portion of the track intermediate its vertical and horizontal portions.

Door operator 10 comprises a fluid actuated device including an elongated work cylinder 31 in which there is a piston, not visible. A conventional single acting hydraulic work cylinder is used in the preferred embodiment. The usual piston rod, not visible, is fastened to the piston and it has an extension 32 fastened to it. Extension 32 has a hole 33. An E-shaped sheave carrier or frame 34 has its center leg 35 fastened to extension 32 by welding in this example. The outside legs 36 and 37 of the frame extend in the same direction as its center leg 35 and the outside legs have holes aligned with hole 33 in the extension for receiving a headed pin or shaft 38. It will be evident that when fluid pressure is delivered to cylinder 31 by way of hose 39 which is connected to the cylinder with a connector 40, the piston in the cylinder will move to the right in the drawing and the frame 34 will be translated or shifted to the right.

A clamp 41 with a space block, not visible, behind it contributes toward securing cylinder 31 in a fixed position on the wall of the building. The cylinder is also anchored to a fixed mounting plate 42 by means of a pair of upstanding flat members 43 and 44 which are welded, respectively, to the cylinder 31 and plate 42. There is also a block 45 fastened to mounting plate 42. Flat members 43 and 44 and block 45 have aligned holes in them such as the hole marked 46 and shown in dashed lines in the block. A headed shaft 47 extends through the holes.

Pairs of sheave means 48 and 49 are rotatably mounted on shaft 47. Sheave means 48 is split into two sheaves 50 and 51 which have two and one cable grooves, respectively, in their peripheries. Sheave means 49 is split into two parts 52 and 53 which also have two and one, respectively, cable grooves in them. It will be seen that the pair of sheave means 48 and 49 are rotatable about the axis of shaft 47 but they cannot translate.

Shaft 38 on translatable E-shaped frame 34 at the other end of the actuator also has a pair of sheave means 55 and 56 mounted on it for rotation. Sheave means 49 on stationary shaft 47 and sheave means 55 on translatable shaft 38 have several loops of a cable reeved or looped around them. One end of cable 57 is permanently fastened with a clamp 58 to block 45. The cable originates at clamp 58 and, after making several turns around sheaves 55 and 49, an end portion 59 of the cable leaves the sheaves and runs over a direction changing single-groove sheave 60 where it changes direction from horizontal to vertical. The extreme end of cable portion 59 is connected to a bracket 61 which is fastened to the lowermost panel 15 of the folding door.

Sheave means 48 on stationary shaft 47 and sheave means 56 on translatable shaft 38 also have a cable 65 reeved or looped around them. Cable 65 has one end fastened to clamp 41 which supports the cylinder 31 and, after running around the sheaves, a portion 66 of the cable extends away from the sheaves. This portion runs over a single-groove sheave 67 which changes the direction of the cable. The end of cable portion 66, after having run over sheave 67, connects to a bracket 68 which is fastened to the bottom panel 15 of the door.

It will be evident that when pressurized fluid is supplied to cylinder 31 by way of fluid line 39, the piston rod in the cylinder will be extended such as to translate frame 34 and the sheave means 55 and 56 carried thereon. This increases the distance between the pair of translatable sheave means 55 and 56 and their cooperating pair of stationary sheave means 48 and 49 so as to simultaneously and equally increase the distance between the translatable sheave means and their cooperating stationary sheave means. This separation of the pairs of sheaves puts the cables 57 and 65 in tension not only in the runs between the sheaves but also in the respective end portions 59 and 66 whereby the door 10 is lifted.

It will be evident that the distance through which the sheave means 55 and 56 translate linearly will be amplified due to each loop of cable between the pairs of sheaves being taken up by a proportional amount in which case the door will travel a distance that is equal to the sum of these amounts. Hence, with a small piston travel, the door is caused to travel a great distance.

To close the door, it is only necessary to bleed the pressurized fluid from the cylinder 31 by way of tube or line 39 in which case the weight of the door will create tension on the cables such that the translatable sheaves 55 and 56 will be pulled by cable tension toward their inactive position in which they are shown in FIG. 1. The rate at which the door closes may be controlled by throttling the rate of discharge out of cylinder 31.

Figure 2:
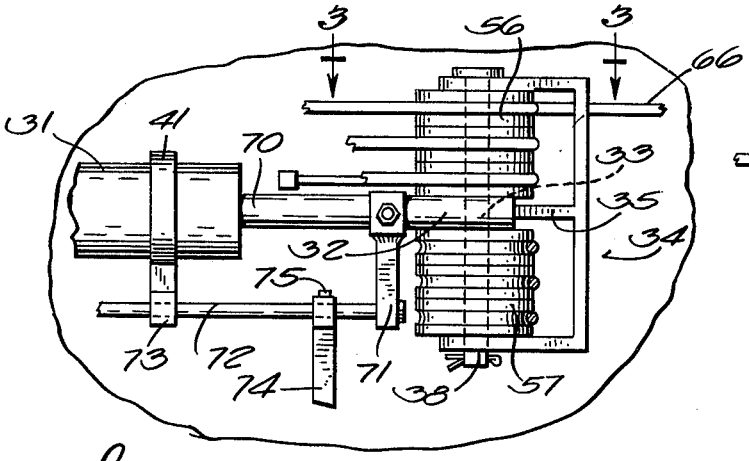
FIG. 2 is a fragmentary view of one end of the operator with some parts omitted.
Figure 3:
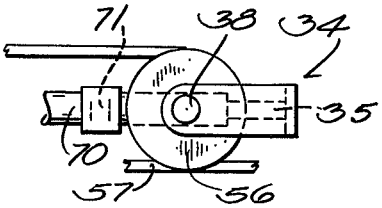
FIG. 3 is a fragmentary view, partly in section, in one of the translatable sheaves looking in the direction of a line corresponding with 3—3 in FIG. 2.

A limit switch operator will now be described. Referring to FIGS. 2 and 3 where the piston rod 70 is clearly visible, one may see that there is an arm 71 fixed on the piston rod. A cross shaft or rod 72 is supported by arm 71 and it is further supported in a linear bearing 73 mounted to the cylinder clamp 41. Rod 72 may be seen in FIG. 2 to carry a follower 74 which is settable lengthwise of rod 72 by loosening a set screw 75, sliding the follower 74 to a position for actuating a limit switch at the proper time, and then retightening the set screw.

Referring again to FIG. 1, one may see that rod 72 carries another follower 76 which is also adjustable lengthwise of the rod. Followers 74 and 76 are for actuating limit switches that are located adjacent their line of travel. In FIG. 1, follower 74 may be seen to be actuating or opening a limit switch 75 which opens to stop closing of the door simultaneously with the door reaching its desired closed limit. In other words, this limit switch is actuated when the work piston is contracted into cylinder 31. Follower 76 is shown spaced from the door opening limit switch 77. When the pulley means 55 and 56 are translated to open the door as described above, follower 76 will ultimately strike and operate door opening limit switch 77 simultaneously with the door reaching its desired open limit. The manner in which the limit switches are connected into the control circuitry will be described later.

Referring further to FIG. 1, the fluid actuated door operator is driven by a hydraulic pump assembly which is generally designated by the reference numeral 80. This assembly comprises a pump 81, a motor 82 for driving the pump and an accumulator or fluid storage vessel 83. Associated with the pump is a valve assembly 84. When the overhead door is to be opened, pump motor 82 is energized and the pump 81 causes pressurized fluid to be delivered over tube 39 to the fluid actuator cylinder 31 to drive its piston outwardly. Upon this event, a check valve, not visible, in valve assembly 84 closes and maintains fluid pressure in the cylinder 31, thus preventing the door from closing.

Closing the door involves energizing a solenoid operator 85 associated with the valve assembly 84 to operate a valve in the assembly which allows fluid to drain or bleed back from cylinder 31 through line 39 to accumulator or storage vessel 83. The rate at which fluid is bled from cylinder 31 may be controlled by adjusting a flow control valve in line 39 in which case the rate at which the door descends can be controlled accordingly. Solenoid 85 is shown as being supplied with a pair of conductors 86 in a conduit which runs into a control box 87 that contains other electrical controls which will be described later in reference to FIG. 4. Shown for purposes of illustration next to control box 87 is a push button station 88 which has push buttons for issuing various commands to the door operator as will be explained later in reference to the control circuit diagram. The control box and push button station may be located at any convenient place in the building.

Figure 4:
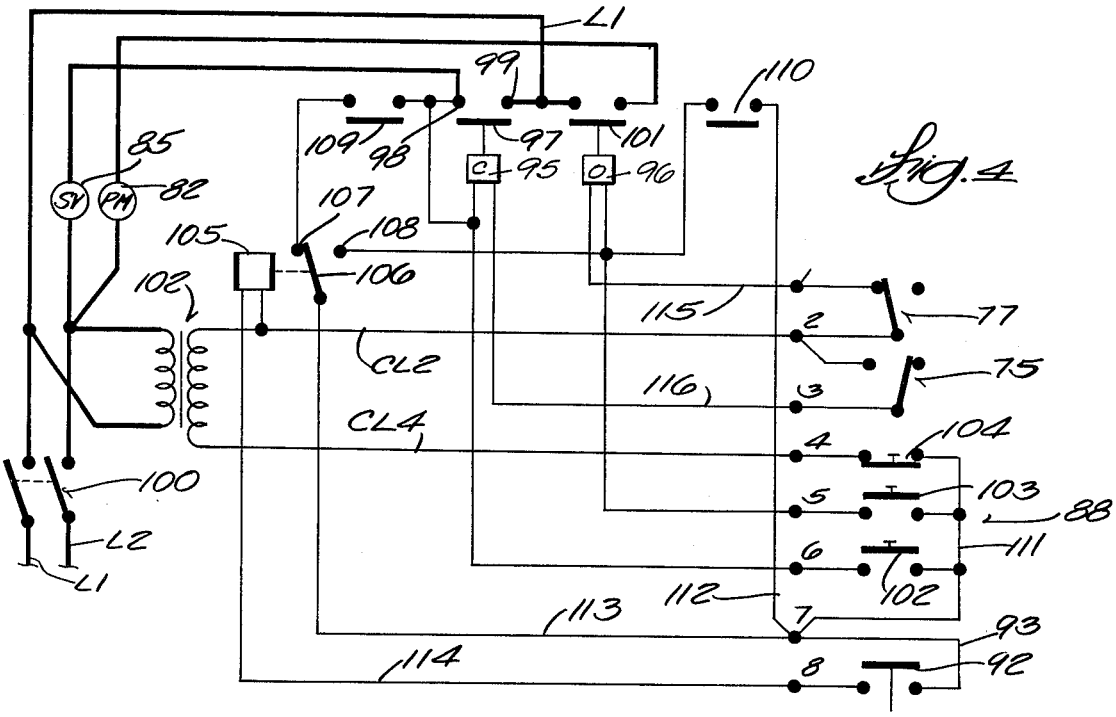
FIG. 4 is the basic control circuit diagram for use with the new operator.

Also in FIG. 1 one may see that the bottom edge of the lowermost door panel 15 has a flexible sheath 89 fastened to it which is involved in a safety or emergency stop function. A soft rubber hose 90 extends into and is substantially coextensive with the length of the sheath. Hose 90 runs into a pneumatic switch assembly 91. Within the switch assembly 91, contacts 92 which are not visible in this figure are shown in FIG. 4. These contacts are in circuit with a two conductor cable 93 which is shown mostly in broken lines and runs into control box 87. As will be explained later, if the door encounters an obstruction while it is being lowered, the impact will be sensed by hose 90 and a pressure pulse will develop in it which will actuate switch contacts 92. The result is that the solenoid valve which is bleeding cylinder 41 during door closing will close immediately and pump motor 82 will be started simultaneously to drive the door in the opening direction away from the obstruction. It will be noted that the control circuits are simple compared to those for doors operated by electric motors because the motor need never reverse.

The electrical circuitry for controlling the door operator will not be described in reference to the FIG. 4 circuit diagram. In this diagram, heavier lines are used for the part of the circuit which is at power line voltage such as at 120 volts. This part of the circuit includes solenoid valve coil 85 and pump motor 82 and their supply lines and contacts. The lighter lines are used to indicate the lower voltage, such as 24 volt, control circuitry.

The incoming 120 volt or other high voltage power lines are marked L1 and L2. The controller has relay coils 95 and 96 also marked C for close and O for open, respectively. Coil 95 is energized when the door is closing and coil 96 is energized when the door is opening. When coil 95 is energized, the contact 97 carried on its armature closes a circuit between contacts 98 and 99 to complete a circuit from L1 through solenoid valve coil 85 and then to L2 if the main switch 100 is closed. Energizing solenoid coil 85, of course, opens the valve for allowing fluid to bleed from hydraulic cylinder 31 under the influence of pressure created by the weight of the overhead door acting through the cables and sheaves on the piston in cylinder 31.

When relay coil 96 is energized, its contact 101 completes a circuit from L1 through pump motor 82 to L2 in which case the pump motor drives the pump which supplies pressurized fluid to cylinder 31 for opening the door as was described earlier. It should be appreciated that semiconductor switches such as silicon bilateral switches, not shown, could be used in place of electromechanical relays 95 and 96.

Low voltage for the control circuitry is obtained with a stepdown transformer 102 whose primary winding is connected across L1 and L2. Its low voltage output lines from its secondary winding are marked CL2 and CL4 to indicate that they are main control voltage supply lines.

The user controls operation of the door from a push button station 88 which has three push buttons 102, 103 and 104. Push button 102 is a normally open push button which is pressed when door closing is desired. Push button 103 is a normally open push button which is pressed when door opening is desired. Push button 104 is normally closed and it is pressed to stop the door at will from closing or opening under emergency conditions, for example. A limit switch which opens when the door reaches its closed limit is marked 75 in FIG. 4 as it is in FIG. 1. A limit switch for interrupting travel when it reaches its open limit is marked 77 as it is in FIG. 1. The contacts of a safety switch are marked 92. They are the contacts in the pneumatically operated safety switch assembly which was marked 91 in FIG. 1. The terminals for interconnecting the switches just mentioned with the remainder of the circuitry are marked 1–8. The operating coil of a safety relay is marked 105 and its movable contact is marked 106. Safety contact 106 is movable between a pair of stationary contacts 107 and 108. The main relay 95 controls door closing and has an associated set of holding contacts 109 and the relay 96 which controls door opening has associated holding contact 110.

The function of the control circuitry in FIG. 4 will now be described. Note that control line CL4 connects to termenal 4 so that terminal 4 may be considered the hot line. By way of example, assume that the door is closed and that the user desires to open it. At this time the close limit switch 75 will be opened as shown. To open the door, the user presses and closes push button switch 103. This energizes the open relay 96 and it changes from a nonconductive to a conductive state and completes a circuit beginning at hot line CL4 and terminal 4 and proceeds through closed stop switch 104, common jumper 111, push button switch 103 which is momentarily closed, open relay coil 96, and then through open limit switch 77 which is now closed, whereupon return is made to terminal 2 and CL2. When relay 96 is energized, it contact 101 completes the circuit through pump motor 82. Holding contacts 110 also close and stay closed even though push button 103 is released. This maintains coil 96 in an energized state through a series circuit starting at terminal 4 and continuing through normally closed stop switch 104, jumper 111, line 112, contacts 110, coil 96, and back to terminal 2 and CL2 through line 115 and now closed open limit switch 77. When the door opens sufficiently to open the contacts of open limit switch 77, coil 96 is deenergized, thereby opening its contact 101 and deenergizing pump motor 82.

Door closing is achieved by the user pressing normally open close push button 102. This completes a circuit from hot line terminal 4 through closed stop switch 104, jumper 111, momentarily closed push button switch 102, coil 95 to terminal 3 by way of line 116, close limit switch 75 which is now closed, and back to terminal 3 and CL2. When door opening relay coil 95 is energized, it changes from a nonconductive to a conductive state and its contact 97 closes to complete a circuit from line L1 through the solenoid 85 of the bleeder valve and back to line L2. When solenoid 85 is energized, fluid is relieved or bled from cylinder 31 due to the weight of the door being transmitted to the piston by way of cables 66 and 59 in FIG. 1 as explained earlier. When close relay 95 is energized by momentary closing of push button switch 102, its holding contact 109 closes to maintain relay coil 95 in an energized state until the close limit switch 75 opens. Thus, as soon as holding contacts 109 close, coil 95 is kept energized through a circuit beginning with terminal 4 and continuing through normally closed stop push button 104, jumper 111, terminal 7, line 113, safety switch contacts 106 and 107, holding contact 109, coil 95, terminal 3, limit switch 75 which is now closed, and back to terminal 2 and CL2. When the door reaches the limit of its closing travel, limit switch 75 opens to thereby deenergize coil 95 so that solenoid valve operator 85 will be deenergized to terminate bleeding of the work cylinder 31.

Now to be described is the manner in which travel of the door is interrupted and reversed if the door encounters an obstruction such as an individual standing in its path or a part of an automobile extending through the door when the door is closing. When the bottom edge of the door collides with an object in its path, the pneumatic tube 90 gets a pressure pulse so as to operate pneumatic switch 91 and its contact 92 as was described in connection with FIG. 1. This closes safety contact 92 in FIG. 4 to energize safety relay coil 105. When coil 105 is energized, the safety switch changes to another of its two conductive states and its movable contact 106 is transferred from stationary contact 107 to stationary contact 108. This results in high voltage electric power being applied to the door opening relay coil 96, which, as was explained earlier, causes the pump motor 82 to be energized in which case driving the door in the open direction begins immediately.

The circuit for energizing safety relay coil 105 begins at terminal 7 which is supplied from hot control line CL4 and continues through contacts 92 which are now closed, terminal 8, line 114, safety relay coil 105 and back to control line CL2. When movable contact 106 transfers to contact 108, a circuit is completed from terminal 7 which is supplied from hot line CL4 and it continues over line 113, contact 106, stationary contact 108, door opening relay coil 96, line 115, limit switch 77 which is now closed, terminal 2, and back to control line CL2. Meanwhile, holding contact 110 has locked in to maintain open relay coil 96 in an energized state even though safety contact 92 has reopened when the reversely driven door has moved away from the obstruction. The door will continue opening until the open limit switch 77 is actuated as is the case when the door is opened in the normal manner by pressing push button 103.

Figure 5:
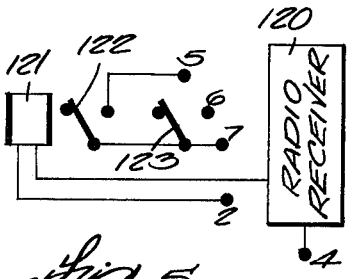
FIG. 5 is a diagram of a circuit which is used for adapting the door to radio control.

FIG. 5 is an optional circuit for adapting the door operator to remote radio control. The radio receiver unit is labeled and is further identified by the reference numeral 120. This unit, like other known receiver units which are used with conventional mechanical door openers, responds to transmitted radio waves at a proper frequency by causing contacts, not shown, in the unit to close. For present purposes, it is sufficient to appreciate that when an appropriate radio frequency transmission is received by unit 120, contacts close and a relay 121 in FIG. 5 may become energized. Contact closing connects coil 121 across the low voltage control lines CL2 and CL4 since terminals 2 and 4 in FIG. 5 are connected to terminals 2 and 4 in FIG. 4, respectively. The relay coil 121 is associated with movable contacts 122 and 123 which are connected in common to terminal 7 in FIG. 5 and correspondingly in FIG. 4. Terminal 7 connects to terminal 4 so it is a hot line. The relay has stationary contacts in FIG. 5 which, as may be seen from their corresponding numbers, connect to terminals 5 and 6 of the terminal strip in FIG. 4. When the radio receiver 120 receives energy from a transmitter, not shown, for opening the door, for instance, relay coil 121 becomes energized and contacts 122 and 123 close the circuits from terminal 7 to terminals 5 and 6. If the door was closed and is to be opened by the radio receiver, completing the circuit between terminals 5 and 7 is equivalent to operating open push button switch 103 with consequences that were described earlier in connection with direct manual opening. When terminals 5 and 7 in FIG. 5 are connected by contact 122 as just described in connection with door opening, a connection is also established by movable contact 123 between terminals 7 and 6 which are for door closing. However, when door opening is initiated, the connection between terminals 7 and 6 produces no response because at that time the door closing limit switch 75 is open. It should also be observed that relay coil 121 only needs to be energized momentarily to open the door since as soon as the opening relay coil 96 is energized it locks in with its holding contacts 110.

If the door is open and the user desires to close it under radio control, the receiver 120 is again energized as is relay coil 121 in FIG. 5. This results in movable contact 123 establishing a circuit between terminals 6 and 7 in FIG. 4 which is equivalent to pressing the close push button switch 102 in the push button station 88. This causes closing relay coil 95 to be energized and to lock in until close limit switch 75 is opened at it is when the door reaches its fully closed position. When closing by making a connection between terminals 6 and 7, the opening circuit between terminals 7 and 5 in FIG. 5 has no effect because open limit switch 77 is initially open.

Figure 6:
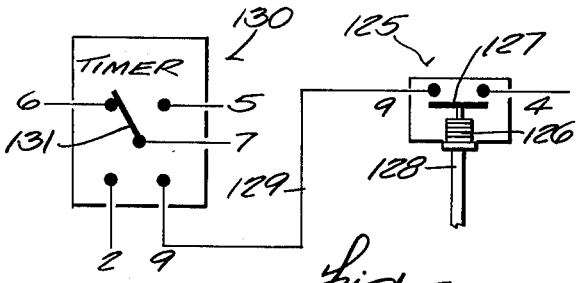
FIG. 6 shows two components which are used when the door operator is adapted for being controlled with a treadle opening device and for closing with a timer.

Devices for adapting the control circuitry of FIG. 4 to make the door open when an approaching automobile or person puts pressure on a treadle and for closing the door after a predetermined time period following entry of the person or automobile through the door is shown in FIG. 6. The treadle switch is designated generally by the reference number 125. It has a pneumatic operator 126 in it which actuates a contact 127 to close the circuit between terminals marked 4 and 9. The pneumatic operator is actuated by an air pressure pulse generated in a rubber hose 128 which lies across the path of the automobile and which is run over as the automobile approaches the overhead door. The contacts 4 and 9 in pneumatic switch 125 are connected in series by means of a conductor 129 with terminals 9 and 2 of a timer 130. This may be an electronic or pneumatic timer. In any event, when power is applied across terminals 9 and 2 of time 130, suitable circuitry, not shown, causes a movable contact 131 to transfer from contacting terminal 6 in the time to contacting terminal 5. Thus, a circuit is completed between terminals 5 and 7 of timer 130 simultaneously with an automobile running over hose 128. Terminals 5 and 7 in the timer are connected across the corresponding terminals 5 and 7 in FIG. 4. Thus, closing the circuit between terminals 5 and 7 in the timer is equivalent to shunting around open push button switch 103 or, in effect, it is the same as closing switch 103. This energizes open relay coil 96 so the pump 82 runs and the door opens. After a time period has expired which is sufficient to assure that the automobile will have passed through the door and will be in the building, contact 131 in timer 130 is automatically restored to make a contact with terminal 6 as shown in FIG. 6. This completes a circuit between terminals 7 and 6 of the timer and these terminals are connected across the correspondingly numbered terminals 7 and 6 in FIG. 4. This is equivalent to establishing a closed circuit shunt in parallel with closed push button switch 102. Hence, closing relay coil 95 becomes energized and so does solenoid valve operator 85 in which case fluid is bled from the cylinder 31 and the door closes under the influence of its own weight. The self-closing feature may be eliminated if desired by simply disconnecting the conductor to terminal 6 in FIG. 6 in which case contact 131 only needs to transfer momentarily to initiate door opening action. It should be appreciated that the safety switch 91 and its contacts 92 will still be operable to cause the door to reverse its downward closing motion if the door is obstructed while it is being closed automatically by the timer switch assembly 130.

I claim:

1. Apparatus for opening and closing a door comprising:

a door that is mounted for movement between one position in which it closes an opening and another position generally above the opening, a fluid actuated device including a cylinder, a piston movable therein and a piston rod, first sheave means mounted to said piston rod for rotation and for translating with said rod, second sheave means and stationary means on which said second sheave means is mounted for rotation in spaced relationship with said first sheave means, cable means looped a plurality of times around said first and second sheave means and having opposite free end portions for being attached, respectively, to spaced apart places on said door, pump means operative to supply pressurized fluid to said cylinder to extend said piston rod and translate said first sheave means away from said second sheave means to thereby enlarge the size of said cable loops and create tension in said cable for opening said door, means for closing said door including means for relieving fluid from said cylinder for enabling tension created in said cables by the weight of the door when said door is unclosed, to translate said first sheave means toward said second sheave means and reduce the size of said loops, an elongated member mounted for translating lengthwise in opposite directions in correspondence with said piston rod, limit switch operator means mounted to and adjustably positionable along said elongated member, a plurality of limit switches in the path of travel of said switch operator means for being actuated, respectively, in correspondence with said door reaching its fully open and fully closed positions, motor means for operating said pump means, solenoide operated valve means operable to open and cause said relieving of fluid for closing said door when one of said limit switches is not actuated, means for controlling said valve means to close in response to actuation of said one limit switch when said door reaches the limit of its closing travel, means for controlling said motor means to start for opening said door, and means for controlling said motor means to stop in response to actuation of another of said limit switches when said door reaches the limit of its opening travel.

2. The apparatus as in claim 1 wherein:

said translatable sheave means comprise first and second sheave means in a coaxial pair of sheave means, said stationary sheave means comprise first and second sheave means in a coaxial pair of sheave means, said cable means comprising two separate cables one being anchored at one end and being looped around said first sheave means in opposite pairs and having one of said free end portions, and the other being anchored at one end and being looped around said second sheave means in opposite pairs and having the other of said free end portions.

3. Apparatus for opening and closing a door comprising:

a door that is mounted for movement between one position in which it closes an opening and another position generally above the opening, a fluid actuated device including a cylinder, a piston movable therein and a piston rod, first sheave means mounted to said piston rod for rotation and for translating with said rod, second sheave means and stationary means on which said second sheave means is mounted for rotation in spaced relationship with said first sheave means, cable means looped a plurality of times around said first and second sheave means and having opposite free end portions for being attached, respectively, to spaced apart places on said door, pump means operative to supply pressurized fluid to said cylinder to extend said piston rod and translate said first sheave means away from said second sheave means to thereby enlarge the size of said cable loops and create tension in said cable for opening said door, means for closing said door including means for relieving fluid from said cylinder for enabling tension created in said cables by the weight of the door when said door is unclosed, to translate said first sheave means toward said second sheave means and reduce the size of said loops, electric motor means operatively coupled with said pump means, said means for relieving said fluid including electrically operated valve means, tube means coupling said pump means and valve means to said cylinder, door opening electric relay switch means and door closing electric relay switch means each being selectively operable to conductive and nonconductive states, a first manually operable switch operable to cause said door opening relay switch means to become conductive for energizing said motor means and cause said door to open, door opening limit switch means operative to cause said door opening relay switch means to become nonconductive for deenergizing said motor means when said door is fully open, a second manually operable switch operable to cause said door closing relay switch means to become conductive for energizing said electrically operated valve means to enable fluid to be relieved from said cylinder to close said door, and door closing limit switch means operative to cause said door closing relay switch means to become nonconductive to thereby deenergize said electrically operated valve means when said door is fully closed.

4. The apparatus as in claim 3 including:

safety switch means having first and second conductive states, means mounted to said door and operable in response to said door meeting an obstruction to change the state of said safety switch means, and said safety switch means when in said first state maintaining said door closing relay switch means in its said conductive state and said safety switch means when changed to its second state causing said door closing relay switch means to switch to its nonconductive state and causing said door opening relay switch means to switch to its conductive state for energizing said pump motor and causing said door to reverse and move in the open direction away from said obstruction.

5. The apparatus as in claim 4 wherein said safety switch means includes a pneumatically responsive operator, said means operable to change the state of said switch means is a hose coupled to said operator that responds to deformation by an obstruction by increasing the pressure in it for actuating said operator.

6. The apparatus as in claim 3 including a third manually operable normally closed switch means operable to simultaneously switch said both of said door closing and door opening relay switch means to their nonconductive states, whereby to stop door opening and door closing.

7. The apparatus as in claim 3 including:

treadle means for being located outside of said door in the path of said door, treadle switch means which has conductive and nonconductive states and changes states in response to a force being applied to said treadle means, timer means responsive to said treadle switch means changing state for a short interval by initiating a predetermined timing period, and switch means controlled by said timer means to change from a first state to a second state when said timing period is initiated and to change back to a first state when said period expires, said switch means when in said second state controlling said door opening relay switch means to change to its conductive state to thereby cause opening of said door, and said switch means when back in said first state controlling said door opening switch means to change to its conductive state to thereby cause automatic closing of said door.

8. The apparatus as in claim 3 including:

a radio receiver and relay means energized in response to radio frequency signals being received by said receiver, and a pair of switching circuits controlled by said last named relay means to close simultaneously, said switching circuits being in circuit with said opening and closing limit switch means and with said opening and closing relay switch means, respectively, such that when said radio frequency signal is received when said door is closed said circuit including said opening limit switch means will be closed for switching said closing relay switch means to its conductive state and when said relay means is closed upon receipt of said radio frequency signal said circuit including said closing limit switch means will be closed for switching said closing relay switch means to its conductive state.

* * * * *